US006485073B2

(12) United States Patent
Harrison

(10) Patent No.: US 6,485,073 B2
(45) Date of Patent: Nov. 26, 2002

(54) ANIMAL REFUSE SHOVEL WITH ATTACHABLE BAG

(76) Inventor: Jeffrey A. Harrison, 4035 Carmel View Rd., #114, San Diego, CA (US) 92130

( * ) Notice: Subject to any disclaimer, the term of this patent is extended or adjusted under 35 U.S.C. 154(b) by 0 days.

(21) Appl. No.: 09/972,087

(22) Filed: Oct. 5, 2001

(65) Prior Publication Data

US 2002/0008392 A1 Jan. 24, 2002

Related U.S. Application Data

(63) Continuation-in-part of application No. 09/580,414, filed on May 30, 2000, now abandoned.

(51) Int. Cl.[7] ..... A01K 29/00; E01H 1/12
(52) U.S. Cl. ..... 294/1.4
(58) Field of Search ..... 294/1.1, 1.3, 1.4, 294/1.5, 55, 25; 15/257.1, 257.4, 257.6, 257.7; 248/95, 99; 383/6, 12, 33, 39, 105, 109

(56) References Cited

U.S. PATENT DOCUMENTS

| | | | | | |
|---|---|---|---|---|---|
| 1,265,996 | A | * | 5/1918 | Cerny | 248/99 |
| 3,240,457 | A | * | 3/1966 | Backlund et al. | 248/99 |
| 3,281,178 | A | * | 10/1966 | Fisher | 294/1.4 |
| 3,382,523 | A | | 5/1968 | Parsisson | |
| 3,677,596 | A | * | 7/1972 | Yonaites et al. | 294/1.4 |
| 3,754,785 | A | * | 8/1973 | Anderson | 294/1.4 X |
| 4,012,067 | A | | 3/1977 | Travis | |
| 4,121,866 | A | | 10/1978 | Schall et al. | |
| 4,191,414 | A | | 3/1980 | Dameron | |
| 4,210,351 | A | | 7/1980 | Orofino | |
| 4,222,597 | A | | 9/1980 | Willis | |
| 4,257,635 | A | | 3/1981 | Mainprice | |
| 4,349,224 | A | * | 9/1982 | Shiozaki | 294/1.4 |
| 4,458,932 | A | | 7/1984 | Resch | |
| 4,500,125 | A | | 2/1985 | Olson | |
| 4,705,310 | A | | 11/1987 | Scripter | |
| 4,768,818 | A | * | 9/1988 | Kolic | 294/1.3 |
| 4,875,729 | A | | 10/1989 | Peck | |
| 4,896,912 | A | | 1/1990 | Parnell | |
| 4,958,871 | A | | 9/1990 | Hemans | |
| 5,131,704 | A | | 7/1992 | Li | |
| 5,186,506 | A | | 2/1993 | Gale | |
| 5,400,572 | A | | 3/1995 | Peck et al. | |
| 5,403,050 | A | | 4/1995 | Searing | |
| 5,634,678 | A | | 6/1997 | Bailey | |
| 5,676,411 | A | | 10/1997 | Kwok | |
| 5,718,469 | A | | 2/1998 | Ockerman | |
| 5,868,447 | A | | 2/1999 | Clark et al. | |
| 5,915,769 | A | * | 6/1999 | Kidd | 294/1.4 |
| 6,039,369 | A | | 3/2000 | Stahovic | |
| 6,039,370 | A | | 3/2000 | Dooley, Jr. et al. | |
| 6,113,166 | A | | 7/2000 | Wynn | |

FOREIGN PATENT DOCUMENTS

| | | |
|---|---|---|
| DE | 3325696 | 1/1985 |
| GB | 2198347 | 6/1988 |

* cited by examiner

*Primary Examiner*—Johnny D. Cherry
(74) *Attorney, Agent, or Firm*—Law Offices of James D. McFarland

(57) ABSTRACT

A shovel and bag assembly for scooping animal refuse deposited by a pet animal. The shovel comprises a handle, a spaded loop including a spade with a protruding leading edge, a first and second support arm for the spade, a base, and a first and second extended corner. The spade and the two extended corners are configured to affix and tension the bag in an open configuration. The extended corners may each comprise a shoulder that assists in tensioning and holding the bag. In addition, the support arms may comprise a curved section proximate to the spade, which increase the tension along the underside of the spade and also widen the opening to facilitate pickup of animal refuse. After scooping the animal refuse into the bag, a rear pocket of the bag is inverted over a forward pocket, covering the soiled forward section and sealing the bag for disposal.

23 Claims, 4 Drawing Sheets

ANIMAL REFUSE SHOVEL WITH ATTACHABLE BAG

CROSS-REFERENCE TO RELATED APPLICATION

This application is a continuation-in-part of U.S. patent application Ser. No. 09/580,414, filed May 30, 2000, entitled ANIMAL REFUSE SCOOPING AND PACKAGING ASSEMBLY, now abandoned which is incorporated by reference herein, and priority is claimed therefrom.

BACKGROUND OF THE INVENTION

1. Field of the Invention

This invention relates generally to devices to scoop up and dispose of waste material, or animal refuse deposited on a surface by a pet dog or other animal.

2. Description of Related Art

A pet dog is said to be housebroken when trained to excretory habits acceptable for indoor living; particularly, a housebroken dog is taught to confine these habits to the outdoors. In a rural environment, this presents no problem because the dog is free to deposit solid waste material or animal refuse in any open field where it can decompose over time. But in urban and suburban communities, where the deposit of animal refuse on sidewalks or in other public places cannot be tolerated, pet owners are now faced with so-called "animal refuse scooper" laws. Such laws mandate that those responsible for a dog or other pet animal must promptly remove animal refuse deposited by the pet on a sidewalk or other outdoor sites. Since a violation of these laws may subject a pet owner to heavy fines, owners seek in various ways to comply with the laws without, however, becoming soiled in the process. Because animal refuse may contain harmful bacteria or could present other health hazards, a sanitary and efficient way to pick up and dispose of animal refuse is needed.

One conceivable way of scooping up animal refuse from the sidewalk would be to use a conventional dust pan and brush. For this purpose, the pet owner would advance the dust pan toward the animal refuse, pushing it with the brush into the dust pan in the same manner as dirt. Then the animal refuse is transferred from the dustpan into a bag suitable for disposal. One practical problem with this procedure (and one reason it is rarely used) is that the dust pan and the brush inevitably become contaminated with the animal refuse, and therefore both must be cleaned (and maybe sterilized) after use.

Another approach is to train the pet dog to deposit animal refuse on a sheet of newspaper placed on the ground by the dog owner who, after a deposit is made, folds the paper into a package for disposal. But this approach leaves much to be desired because it is difficult to train a dog to defer depositing animal refuse until the owner has found a convenient place to lay down a sheet of newspaper. Moreover, it can be an uncomfortable and unpleasant experience for the dog owner to lay down a newspaper sheet and then fold it about an animal refuse deposit.

A more commonly used technique is for a dog owner to place one of his hands in a small, bag, using the biodegradable bag as a glove to pick up the animal refuse. The dog owner then pulls the bag off his hand by inverting it which thereby packages the animal refuse inside the bag so that the animal refuse is bagged and can then be discarded. Apart from the fact that the dog owner is required to handle the animal refuse with his gloved hand-an experience that many find distasteful-a significant problem is the possibility that the biodegradable bag may not be properly sealed or that it will rupture in use and thereby soil the handler.

Another animal refuse handling technique is disclosed in the 1989 patent to Peck, U.S. Pat. No. 4,875,729 (the '729 patent). This approach makes it possible to isolate the handler from the animal refuse and thereby encourage compliance with the "scooper animal refuse" laws. This technique makes use of a triangular frame having a handle attached to its apex, the frame being inserted into a small biodegradable bag so that the broad base of a frame is adjacent the closed end of the biodegradable bag covering the frame. In use, the bag-covered frame is held at an angle to the ground surface on which the animal refuse is deposited, and then advanced to scoop up the animal refuse so that it falls within the confines of the biodegradable bag-covered frame. The user, with his other hand, then inverts the bag so that the outside of the biodegradable bag becomes the inside and the animal refuse is then contained therein to provide a disposable package. One advantage of this technique is that the user's hands are isolated: from the animal refuse and there is no risk of contamination. One practical, drawback of this technique is that it is not always effective in scooping up animal refuse. For example, the mass, firmness and configuration of animal refuse depends on the dog and what the dog excretes on a given occasion. It is not always easy, therefore, simply with a forward motion of the biodegradable, bag-covered frame, to scoop up the animal refuse, for there is no force holding the animal refuse in place or pushing it toward the advancing bag-covered frame. In contradistinction, with a conventional dustpan and brush arrangement, the brush functions as a tool that cooperates with the pan to push waste matter into the pan. In the absence of the brush, a forward motion of the pan may only succeed in pushing the waste matter forward.

U.S. Pat. No. 4,958,871, issued to Hemans (the '871' patent) discloses a hand-held device for picking up animal waste using a scooping device and a fold-lock-top sandwich bag as the receptacle for waste material. The large pocket of the fold-lock-top sandwich bag fits through a central opening in the scoop device while the small pocket completely covers the scooping-type tapered blade, which purportedly prevents soiling of the scoop device by the waste material. A single centrally-located hook is provided opposite the tapered blade for the purpose of attaching the flap of the bag, which maintains the bag in an open configuration. One problem of the scooping device disclosed in the '871 patent is that the hook cannot not hold the sandwich bag firmly in place and furthermore attachment of the hook to the bag creates a rip that, under even small pressure, can extend so far that the flap is released from the hook thereby eliminating the support necessary to hold the bag in an open position. Slippage of the bag during pickup can create difficulties in picking up the waste; for example, as the blade is advanced forward, the friction between the bag and the surface forces the interior of the bag to slip forward, pushing the waste away from the advancing blade. Slippage can also reduce the size of the opening in the bag, which could interfere with picking up the animal waste. Large amounts of slippage could cause the small pocket of the bag to fall away entirely from the blade, leading to possible dropping of the waste.

Dog animal refuse is excrement, and the handling of disease-bearing animal refuse is not only a repellent activity, but one in which there is a risk of contamination. While dog owners are generally law-abiding and have no wish to defy "scooper animal refuse" laws, these laws are nevertheless disobeyed by many dog owners due to the difficulties with prior art refuse scooping devices.

SUMMARY OF THE INVENTION

A shovel and attachable bag assembly is described to scoop up and act as a repository for waste material and/or animal refuse deposited on a surface by a pet animal. In one embodiment, the animal shovel and bag assembly comprises an adjustable handle, a spaded loop, and a biodegradable rectangular biodegradable bag whose dimensions are such to allow the biodegradable bag to be inserted over the spaded loop to allow the central pocket of the biodegradable bag to receive animal refuse. The biodegradable bag creates a pocket to place the animal refuse inside. In operating the assembly, the user grasps the handle in one hand and with a forward stepping motion advances the open end of the attached biodegradable bag along the surface toward the animal refuse, scoops the animal refuse into the bag in the confines of the spaded loop, and the animal refuse tumbles into the bag. Then, after at least partially detaching the bag, the user inverts the bag so that now the animal refuse is inside the biodegradable bag and is packaged thereby in condition for disposal.

An animal refuse shovel for receiving a disposable bag comprises a handle and a spaded loop connected thereto. The spaded loop includes a spade having a protruding leading edge, a first support arm connected on one end of the spade and a second support arm connected on the opposite end of the spade, a base connected between the first and second support arms, a first extended corner at the interface between the first support arm and the base, and a second extended corner at the interface between the second support arm and the base. The spade, the first extended corner, and the second extended corner are configured to affix the bag thereto and to hold the bag under tension in an open configuration to receive the animal refuse. The first extended corner may comprise a first shoulder that extends vertically above the first support arm and the base, and the second extended corner may comprise a second shoulder that extends vertically above the second support arm and the base, which can assist in tensioning the bag. In addition, the first support arm may comprise a curved section proximate to the spade, the curved section extending outwardly in an approximately horizontal direction from the spaded loop, and the second support arm may comprise a curved section proximate to the spade, the curved section extending outwardly in an approximately horizontal direction from the spaded loop. The curved sections increase tension and tighten the forward pocket of the bag along the underside of the spade. The curved sections also widen the opening near the spade, and the portions of the bag stretched over the curved section create barriers that partially enclose the central pocket of the bag and assist in keeping the animal refuse within the bag.

In one embodiment, the disposable bag for affixing onto the animal refuse shovel comprises a central pocket, a downward-facing forward pocket on the front side of the bag, a downward-facing rear pocket on the back side of the bag, and a welded seam at each interface between the forward and rear pockets, the seam welded to the side of the central pocket.

A method of affixing a disposable bag to a shovel for the purpose of shoveling and packaging animal refuse deposited by an animal on a surface comprises inserting a central pocket of the bag into the central opening of the spaded loop, inserting a first pocket of the bag over the leading edge of the spade, inserting a first section of a second pocket of the bag over a first extended corner situated rearward of the leading edge, tensioning the first corner section of the bag over the first extended corner, thereby tensioning the bag between the leading edge and the first extended corner, and affixing the first corner section to the first extended corner. Likewise, a second section of the second pocket of the bag is inserted over a second extended corner situated rearward of the leading edge and opposite from first extended corner, the second corner section of the bag is tensioned over the second extended corner, thereby tensioning the bag between the leading edge, the first extended corner, and the second extended corner, and the second corner section is affixed to the second extended corner. The method may include tensioning the first corner section including pulling the first corner section over a first shoulder provided on the first extended corner of the spaded loop, and tensioning the second corner section including pulling the second corner section over a second shoulder provided on a second extended corner of the spaded loop. The method may also comprise inserting the forward pocket over curved sections on first and second support arms proximate to the spade, and tensioning the bag against the curved sections to tighten the forward pocket along the underside of the spade.

After the bag is affixed to the shovel, a user may shovel animal refuse into the open central pocket of the bag. Subsequently the bag is detached from the first and second extended corners, the rear pocket is inverted over the forward pocket thereby covering the forward pocket and sealing the bag, the forward pocket is removed from the spade, and the bag is disposed of. In this method, the forward pocket may be removed either before inverting the bag or after inverting the bag, depending upon user preference. Some users may prefer to invert the bag over the forward pocket while the spade is holding it in position, in order to avoid unintended contamination.

In one embodiment, the spade is flexible, tapered and has an angle within about 25° to about 35°, (and preferably 30°). One advantage of this embodiment is that the spade can conform to the surface underlying the animal refuse, and a user can, with one hand, advance the biodegradable bag-covered spaded loop toward the animal refuse to be picked up with one easy motion. This can be particularly useful if the use has only one free hand, such as when the other hand is holding a dog leash.

In one embodiment the handle is adjustable to accommodate people of various heights, as well as disabled and/or wheelchair-confined persons. Furthermore, the spaded loop and adjustable handle provides an assembly in its storage mode that is highly compact.

BRIEF DESCRIPTION OF THE DRAWINGS

For a more complete understanding of this invention, reference is now made to the following detailed description of the embodiments as illustrated in the accompanying drawing, wherein.

DETAILED DESCRIPTION

Reference Numerals

Figure 1:
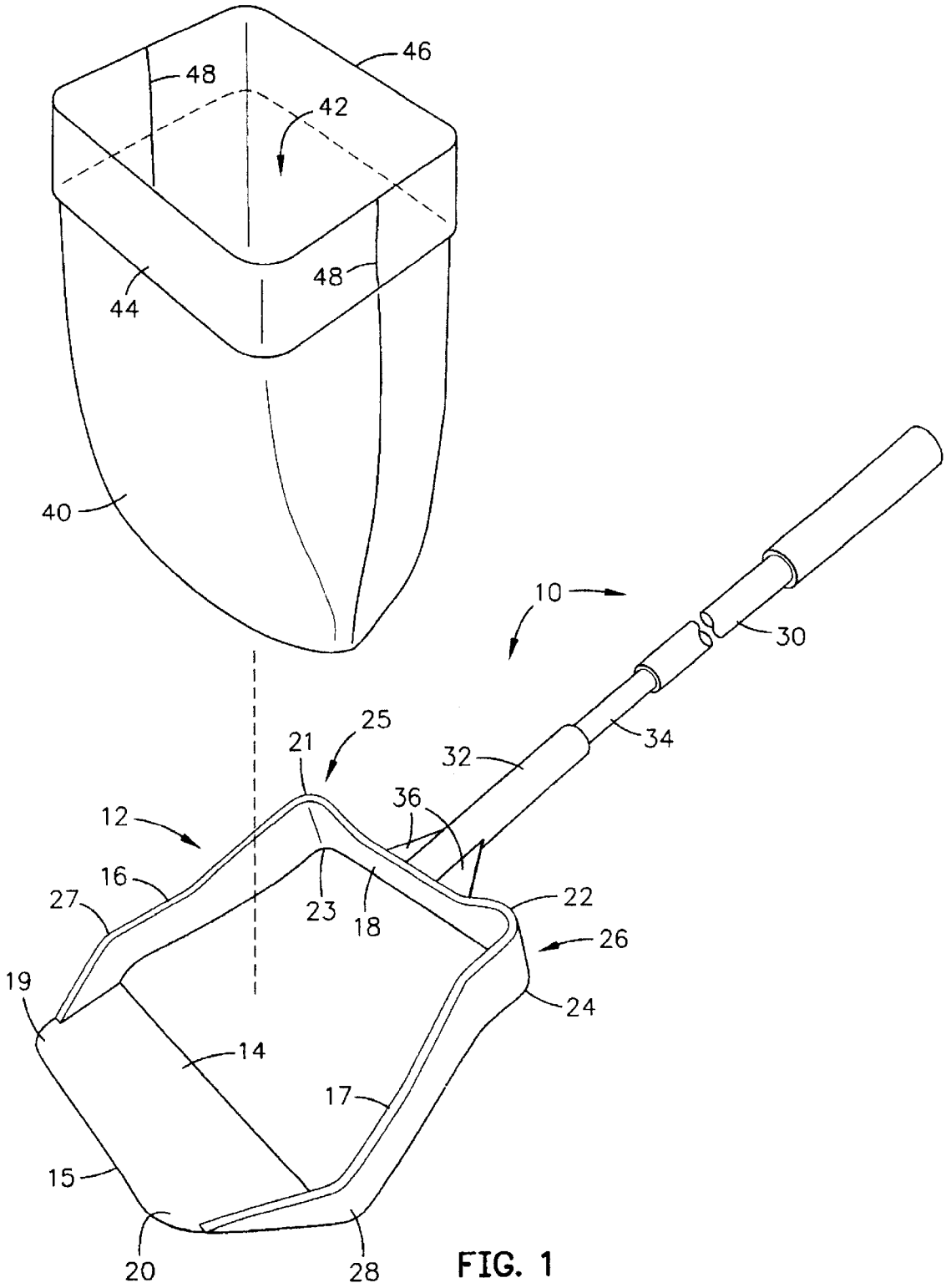
FIG. 1 is a perspective view of a shovel that has a spaded loop and a bag to be affixed onto the spaded loop.

This invention is described in the following description with reference to the Figures, in which like numbers represent the same or similar elements. Following is a partial list of the reference numeral designations:

10-shovel
12-spaded loop
14-spade
15-leading edge of spade
16-first support arm
17-second support arm
18-base
19-first end of spade
20-second end of spade
21-first protruding shoulder
22-second protruding shoulder
23-first lower edge
24-second lower edge
25-first extended corner
26-second extended corner
27-curved section of first support arm
28-curved section of second support arm
30-extendible handle
32-hollow cylindrical connector
34-cylindrical extension of handle
36-handle supports
40-bag
42-central pocket of bag
44-forward pocket of bag
46-rear pocket of bag
48-welded seam
50-hypothetical line between leading edge of spade and shoulder
52-spade angle
54-spade plane
56-shovel handle axis

Description

FIG. 1 is a perspective view of a shovel 10 and a bag 40 that will be affixed onto the shovel, as further described herein. The shovel 10 includes a spaded loop shown generally at 12 and an extendible handle 30 attached thereto by any suitable structure. The spaded loop 12 includes a forward-facing spade 14 having a protruding leading edge 15. First and second support arms 16 and 17 are affixed on opposite ends of the spade; specifically, the first support arm 16 is affixed to a first end 19 of the spade, and the second support arm is affixed to a second, opposing end 20 of the spade, and these arms connect the spade with a base 18. For purposes of description, "horizontal" means generally along a plane defined by the spade, support, arms, and base of the spaded loop, and "vertical" means a direction perpendicular to that plane.

A first extended corner, shown generally at 25, is defined at the interface between the base 18 and the first support arm 16. The first extended corner 25 is rounded, extends horizontally away from the center of the spaded loop, and includes a first shoulder 21 that protrudes vertically above the level of the base and the first support arm. A first lower edge 23 is defined on the first corner 25 below the first shoulder 21. Similarly, a second extended corner, shown generally at 26, is defined at the interface between the base 18 and the second support arm 17. The second extended corner 26 is rounded, extends horizontally away from the center of the spaded loop, and includes a second shoulder 22 that protrudes vertically above the level of the base and the second support arm. A second lower edge 24 is defined on the second corner 26 below the second shoulder 21.

At the junction between the spade and the support arms 16 and 17, the arms are initially very narrow and follow an outward curve set by the respective ends 19, 20 of the spade 14. As the support arms extend in a rearward direction from the spade 14 to the base 18, the support arms become increasingly wider in the vertical direction. Furthermore, the support arms at first extend outward horizontally, and then, at curved sections 27 and 28, the respective first and second support arms 16 and 17 curve back toward the base 18, which in this embodiment has about the same length as the spade. One advantage of this configuration is that it provides a wider opening at the front of the spaded loop, which assists in moving the animal refuse into the bag. Another advantage, discussed in more detail elsewhere herein, is that the wide opening effectively tensions the bag closely onto the downward-facing side of the spade 14.

The base 18 is connected with the extendible handle 30 by any suitable structure. In the embodiment shown in FIG. 1, a hollow cylindrical handle connector 32 is affixed to the base 18, and a complimentary cylindrical extension 34 on the handle is inserted inside the hollow section of the connector to form a secure connection between the spaded loop 10 and the handle 30. A pair of triangular supports 36 provide further structural support for the connection.

In one embodiment, the spaded loop 12, the handle connector 32, and the supports 36 are formed of a single piece of plastic; however other embodiments may be manufactured in a variety of configurations such as multiple pieces of plastic and/or metal. The handle 30 comprises any suitable handle, in one embodiment,the handle comprises a "twist-and-lock" type that can be extended to any suitable length and then twisted to lock it in place for action.

Figure 5:
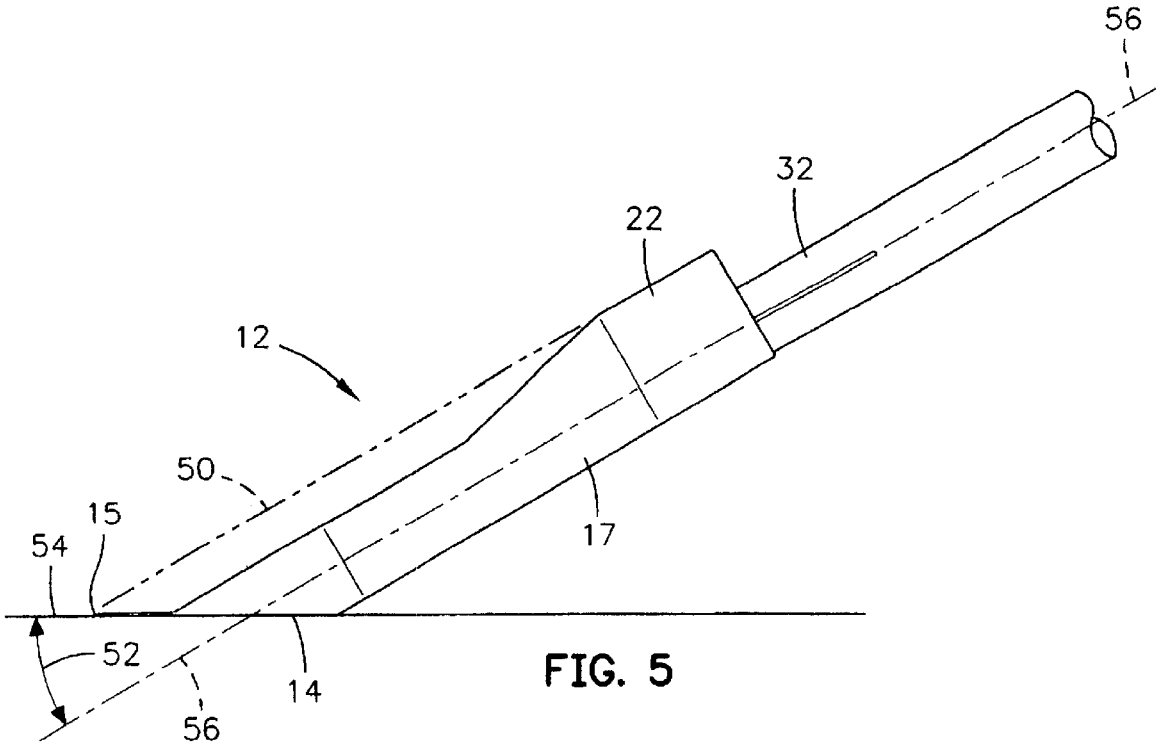
FIG. 5 is a side plan view of the spaded loop.
Figure 6:
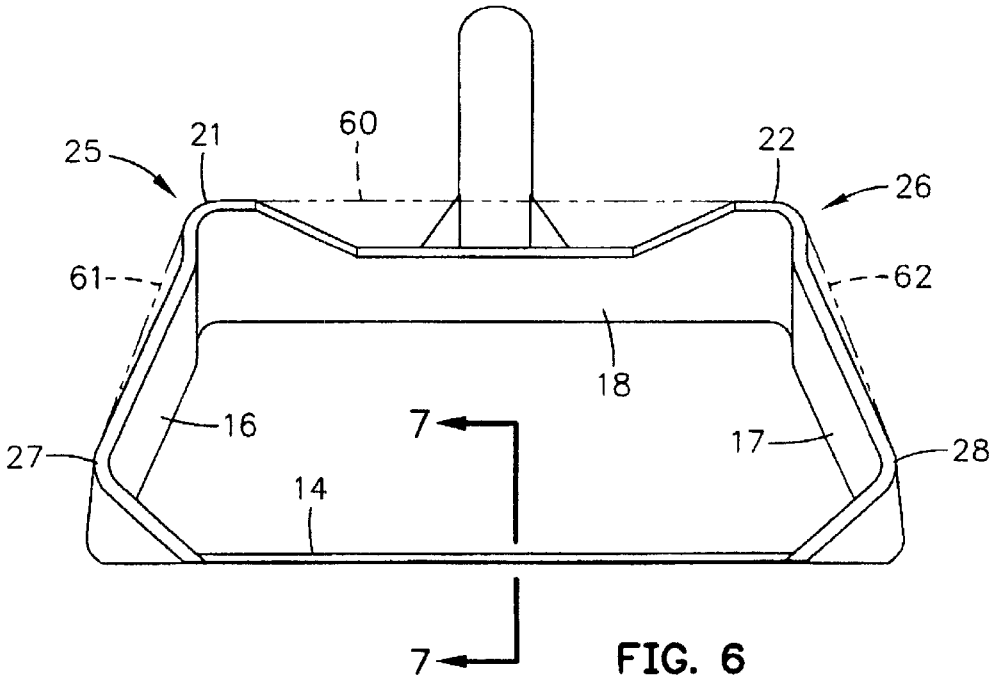
FIG. 6 is a front plan view of the spaded loop.

Reference is briefly made to FIGS. 5, and 6 in conjunction with FIG. 1 to describe the spaded loop 12 in more detail. FIG. 5 is a side plan view of the spaded loop, and FIG. 6 is a front plan view of the spaded loop.

The side plan view of FIG. 5 shows that the second shoulder 22 protrudes above the central section of the second support arm 17. By drawing a phantom dashed line 50 between the leading edge 15 of the spade and the shoulder 22, it can be seen that the interval 50 over the support arm 17 is substantially unobstructed. In a similar fashion, the interval between the first shoulder and the first end 19 over the support arm (FIG. 1) is substantially unobstructed.

The front plan view of FIG. 6 shows that the first and second shoulders 21 and 22 extend above the central section of the base 18. A first phantom dashed line 60 drawn between the first and second shoulders shows that the interval 60 between the first and second shoulders is substantially unobstructed. Furthermore, a second phantom dashed line 61 drawn between the first extended corner 25 and the first curved section 27 shows that this interval 61 is substantially unobstructed, and a third phantom dashed line 62 drawn between the second extended corner 26 and the second curved section 28 shows that this interval 62 is also substantially unobstructed. One advantage of the lack of obstructions on the outer perimeter of the spaded loop is that the bag 40 (FIG. 1) can be stretched and securely affixed to the spaded loop 12 as described herein.

Figure 4:
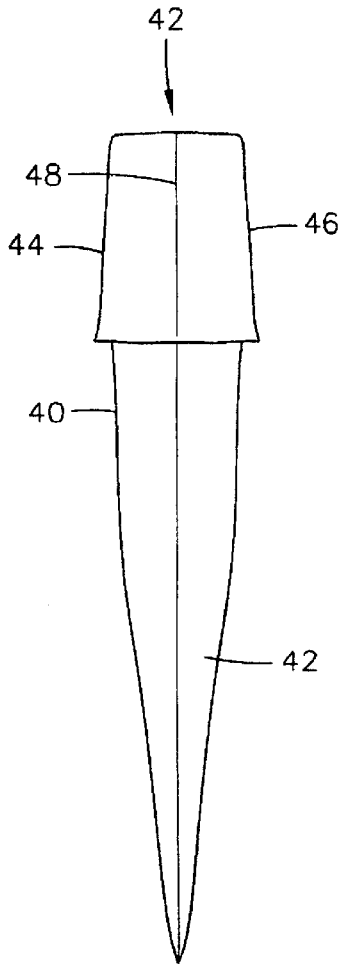
FIG. 4 is a side perspective view of the bag.

Reference is made to FIG. 4, in conjunction with FIG. 1, to describe the bag 40. FIG. 4 is a side perspective view of the bag 40, and FIG. 1 shows the bag 40 expanded for insertion into the spaded loop 12. The bag 40 includes an upward-facing central pocket 42 that serves as a receptacle for animal refuse. The bag also includes two smaller, downward-facing pockets, including a forward pocket 44 on the front side of the bag, and a rear pocket 46 on the opposite side of the bag. At the junction between the forward and rear pockets, a welded seam 48 separates the two smaller pockets and also affixes them to the central pocket of the bag. In alternative embodiments, the welded seam 48 may be omitted, so that the forward pocket is defined by a forward section of a continuous pocket around the entrance of the bag, and the rear pocket is defined by a rear section.

The bag 40 is formed of a somewhat elastic material such as plastic, which allows the bag to be stretched to some extent. The bag 40 in one embodiment comprises a biodegradable plastic. The bag may be manufactured in a variety of ways; generally, the front and rear pockets can be made from a bag that has two flaps extending from the central opening. The two flaps each are folded back over the bag and then affixed to the bag to form the forward and rear pockets, respectively. In one embodiment the bag can be constructed from a single rectangular sheet of plastic (not shown) that is folded once along its length, and then the flaps at both ends are folded back. The two open, opposing edges are then welded together to form the bag.

Figure 2:
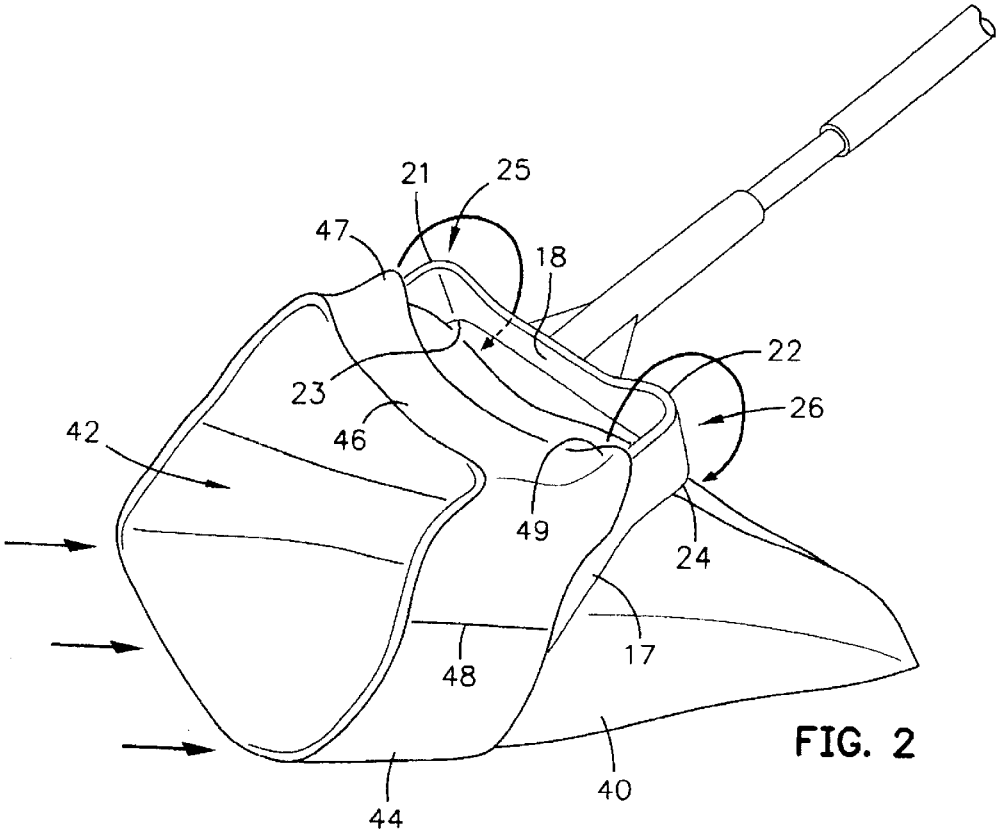
FIG. 2 is a perspective view of the shovel with the forward pocket of the bag affixed to the spade.
Figure 3:
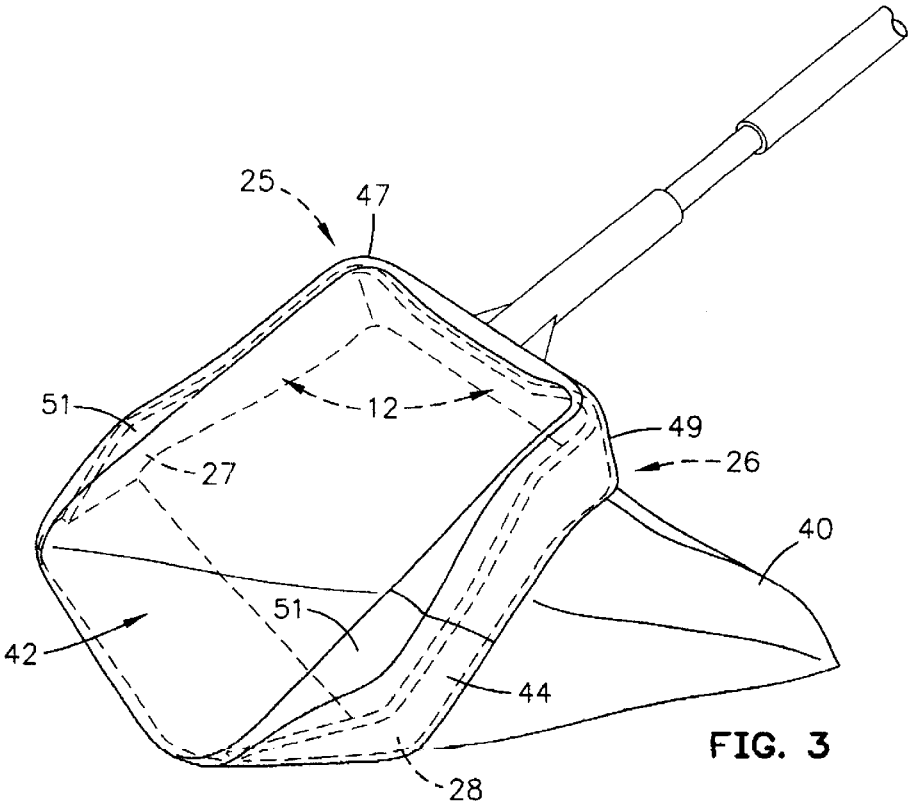
FIG. 3 is a perspective view of the shovel with the bag affixed onto the spaded loop.

Reference is now made to FIGS. 1, 2, and 3 to describe a method for securely attaching the bag 40 to the spaded loop 12. Beginning in FIG. 1, the central pocket 42 of the bag 40 is inserted into the central opening of the spaded loop 12. As the forward pocket 44 approaches the leading edge 15 of the spade 14, it is inserted over the spade. FIG. 2 is a perspective view showing the forward pocket 44 inserted over the spade. Next, as shown by FIG. 2, the rear pocket 46 is pulled over the first and second shoulders 21 and 22, and then latched over the lower edges under the shoulders. More specifically, a first corner section 47 of the rear pocket 44 proximate to the first shoulder 21 is pulled tightly over the first shoulder 21, creating tension in the bag extending between the leading edge of the spade, the curved forward section of the support arms and the first extended corner 25. By pulling harder, more tension is created. When the amount of tension is deemed sufficient by the user, the first corner section 47 is wrapped over the first lower edge 23, which holds the first corner section in place due to the elasticity of the bag and the tension thereon. Similarly, a second corner section 49 of the rear pocket proximate to the second shoulder is pulled tightly over the second shoulder 22, creating additional tension in the bag extending between the leading edge of the spade, the curved forward section of the support arms 16,17, the second extended corner 26 and the first extended corner 25. By pulling harder, more tension is created, and this tension is in addition to the tension created when affixing the first corner section of the bag. When the amount of tension is deemed sufficient by the user, then the second corner section is wrapped over the second lower edge 24, which holds the second corner section in place. By this two-step tensioning process, the bag can be snugly affixed to the spaded loop even in the presence of size variations in the bag; in other words, the spaded loop has a large tolerance for bag size variations.

FIG. 3 is a perspective view of the bag 40 securely affixed to the spaded loop, showing the first corner section 47 wrapped around the first extended corner 25, and also showing the second corner section 49 wrapped around the second extended corner 26. The elasticity of the bag, together with the construction of the spaded loop, creates tension that allows the bag to be stretched tightly around the perimeter of the spaded loop while widely opening the central pocket of the bag. As shown in FIG. 3, the bag is stretched tightly over the first and second support arms, over the base, and over the curved section, 27 and 28, both along the outer perimeter of the curved section, and also along the upper side of the curved sections, spanning the inner gap defined by each curved section as shown at 51. In this embodiment, the lack of obstructions along the interval 50 (FIG. 5) between the leading edge of the spade and the shoulder, the interval 60 (FIG. 6) between the shoulders over the base, the interval 61 (FIG. 6) between the first curved section 27 and the first extended corner 25, and the interval 62 (FIG. 6) between the second curved section 28 and the second extended corner 26 accommodates uniform stretching of the bag and facilitates a snug fit.

Advantageously, the curved sections 27 and 28 on the first and second support arms provide a widened opening that causes the portion of the forward pocket 44 adjacent to the bottom of the spade to be tightly stretched across the underside of the spade. Accordingly, the forward-facing section of the bag, tightly stretched across the leading edge and underside of the spade, provides an excellent surface for effectively shoveling animal waste into the bag, while preventing soiling of the spade or any portion of the shovel assembly. Furthermore, the tension holds the central pocket open, and the two curved sections on the support arms widen the forward section of the opening to facilitate clean pickup of animal excrement. In addition, the plastic stretched over the upper side of the curved sections, shown at 51, operates as a barrier that partially encloses collected material, thereby preventing the collected animal refuse from being unintentionally dropped if the shovel becomes tilted.

Figure 7:
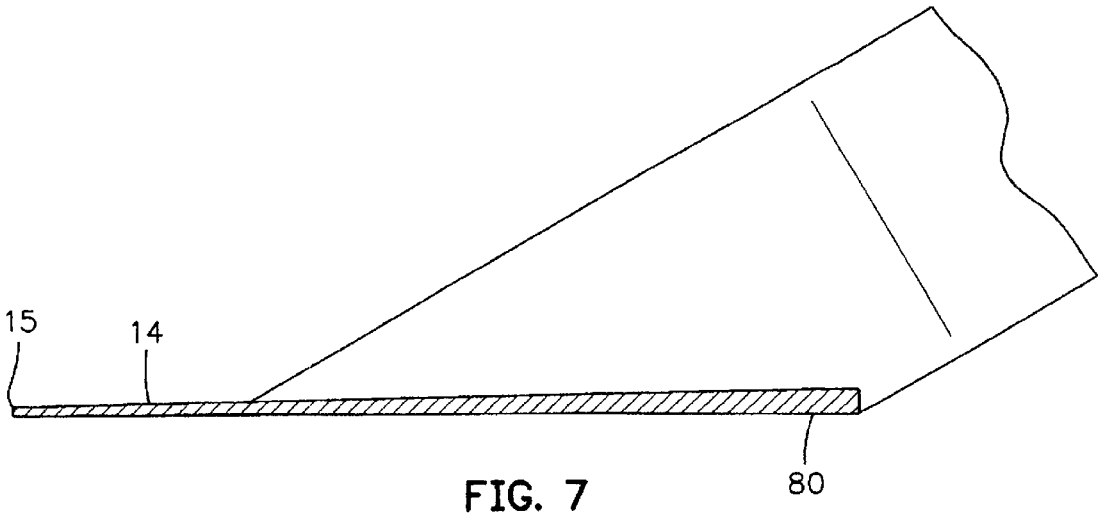
FIG. 7 is a cross-section of the spade along the cut line shown in FIG. 6.

Reference is now made to FIGS. 5, 6, and 7 to illustrate additional features of the spaded loop that can provide advantages for a user in shoveling the animal waste into the bag. FIG. 5, which is a side plan view of the spaded loop, shows a spade angle 52 defined between an approximate planar surface of the spade, shown at 54, and a central shovel axis 56 defined along the handle extension 32, which is coaxial with the handle 30. The spade angle 52 approximates the angle of attack of the spade with respect to the ground upon which the animal waste was laid. A spade angle 52 within the value range of about 25° to about 35° has been found to be effective in shoveling animal refuse and depositing it into the bag, and particularly a spade angle value of about 30° has been found to be very effective. However, it should be recognized that other spade angle values may be utilized that may be effective to some extent.

FIG. 7 is a cross-section of the spade along the cross-section shown in FIG. 6, which is a front plan view of the spaded loop. As can be seen from FIG. 7, the spade 14 is tapered from the forward leading edge 15 to the back of the spade; particularly, the leading edge 15 is thinner than a back section 80 of the spade. One advantage of the tapered spade is that it allows the leading edge of the spade to deform so that it conforms with the surface upon which the animal waste has been deposited. For example, if the animal waste has been deposited upon a rough, uneven surface, such as is typical in a park on bare ground, the tapered spade can flex and conform with the rough, uneven surface to provide effective shoveling of the animal waste into Once the animal waste has been shoveled into the bag, disposal is necessary. The bag is then removed by for example detaching the first and second corner sections (FIG. 2) from their respective lower edges, and then sliding the corner sections forward over the first and second shoulders. The bag may then be detached from the spaded loop by removing the forward pocket from the spade, or alternatively, the forward pocket may remain on the spade until the bag has been closed, as described with reference to FIG. 8.

Figure 8:
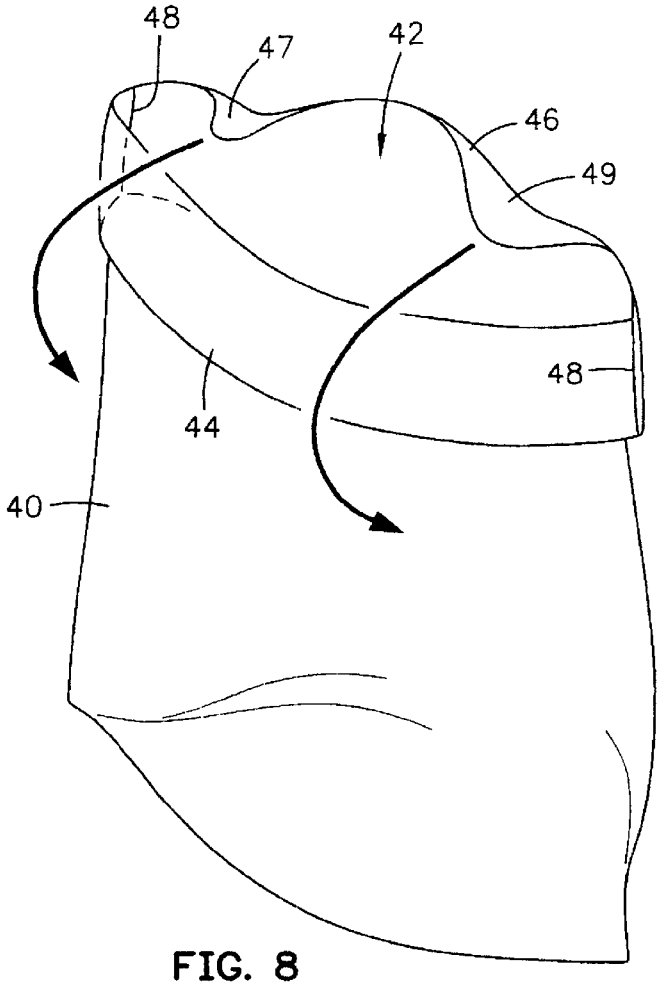
FIG. 8 is a perspective view of the bag with the rear pocket partially inverted, illustrating how the bag is sealed.

Reference is now made to FIG. 8 in conjunction with FIG. 2 to describe a method of sealing the bag to allow disposal of the animal waste. As the forward pocket 44 has undoubtedly been soiled in the process of shoveling the animal excrement into the bag, the user can seal the bag and dispose of it appropriately without being subjected to the risk of contamination. FIG. 8 is a perspective view of the bag 40 with its rear pocket 46 partially inverted by a user into a position where it can be fully inverted over the forward pocket 44 as illustrated by the arrows. Particularly, the rear pocket 46 is turned inside out and folded down to cover the forward pocket 44, which advantageously seals the animal excrement into the bag and covers the otherwise-exposed soiled surfaces of the forward pocket, thereby eliminating the risk of further contamination.

It will be appreciated by those skilled in the art, in view of these teachings, that alternative embodiments may be implemented without deviating from the spirit or scope of the invention, and that it may be utilized in a wide range of applications. For example, the shovel and attached bag may be utilized to pick up any type of out-of-reach object, whether or not it is animal refuse, such as by a person confined to a wheelchair. This invention is to be limited only by the following claims, which include all such embodiments and modifications when viewed in conjunction with the above specification and accompanying drawings.

As another example, although the shovel and bag assembly described herein is designed to be operated as a single unit, it can also be used in conjunction with a device that assists in pushing the animal refuse into the bag. In this example, the user grasps the handle of the spaded loop in one hand, and in the other grasps the device while holding onto the open end of the: biodegradable bag, and then advances the closed end of the biodegradable bag along the surface toward the animal refuse and manipulates the device to push the animal refuse into the bio-degradable bag. Then, after detaching the bag at least partially from the spaded loop, the user inverts the biodegradable bag over the pocket so that now the animal refuse is inside the biodegradable bag and is packaged thereby in condition for disposal.

What is claimed is:

1. A shovel for receiving a disposable bag that has a central pocket, a forward pocket, and a rear pocket, said shovel comprising:

a handle;

a spaded loop connected to the handle, said spaded loop comprising a spade having a protruding leading edge for receiving said forward pocket of the disposable bag so that the leading edge of said spade is substantially covered by the bag;

a first support arm connected on one end of said spade and a second support arm connected on the opposite end of said spade;

a base connected between said first and second support arms;

a first extended corner at the interface between the first support arm and the base;

a second extended corner at the interface between the second support arm and the base; and said first and said second extended corners each having a shoulder over which the rear pocket of the bag is stretched under tension to hold the bag in an open configuration and a lower edge over which said bag is wrapped so that said bag remains tensioned between said spade, said first extended corner and said second extended corner.

2. The shovel of claim 1 wherein:

said first extended corner comprises a first shoulder that extends vertically above the first support arm and the base; and said second extended corner comprises a second shoulder that extends vertically above the second support arm and the base.

3. The shovel of claim 1 wherein said first and second extended corners are rounded.

4. The shovel of claim 1 wherein:

said first support arm comprises a curved section proximate to the spade, said curved section extending outwardly in an approximately horizontal direction from the spaded loop; and said second support arm comprises a curved section proximate to the spade, said curved section extending outwardly in an approximately horizontal direction from the spaded loop.

5. The shovel of claim 1 wherein said spade defines an angle within a range of about 25° to about 35° with respect to the handle.

6. The shovel of claim 1 wherein said handle is adjustable and extendible, and wherein said spade is tapered.

7. An animal refuse shovel and disposable bag assembly that provides a repository for animal refuse deposited by an animal on a surface, comprising:

a bag that comprises a central pocket, a forward pocket, and a rear pocket;

a shovel comprising a spaded loop and a handle;

said spaded loop comprising a spade having a protruding leading edge for receiving said forward pocket of said bag;

a first support arm connected on one end of said spade and a second support arm connected on the opposite end of said spade;

a base connected between said first and second support arms;

a first extended corner at the interface between the first support arm and the base, said first extended corner having a first shoulder over which a first section of said rear pocket is stretched and a first lower edge over which the first section is wrapped to affix said first section of said rear pocket to said spaded loop;

a second extended corner at the interface between the second support arm and the base, said second extended corner having a second shoulder over which a second section of said rear pocket is stretched and a second lower edge over which said second section is wrapped to affix said second section of said rear pocket to said spaded loop; and wherein said spade, said first extended corner, and said second extended corner hold said bag under tension so that said central pocket is held in an open configuration to receive the animal refuse.

8. The assembly of claim 7 wherein:

said first extended corner comprises a first shoulder that extends vertically above the first support arm and the base; and said second extended corner comprises a second shoulder that extends vertically above the second support arm and the base.

9. The assembly of claim 7 wherein said first and second extended corners are rounded.

10. The assembly of claim 7 wherein:

said first support arm comprises a curved section proximate to the spade, said curved section extending outwardly in an approximately horizontal direction from the spaded loop, said curved section receiving a section of said forward pocket and holding said forward pocket under tension; and said second support arm comprises a curved section proximate to the spade, said curved section extending outwardly in an approximately horizontal direction from the spaded loop, said curved section receiving a section of said forward pocket and holding said forward pocket under tension.

11. The assembly of claim 10 wherein a portion of said forward pocket is stretched across each curved section, thereby forming a barrier that partially encloses animal refuse within the bag.

12. The assembly of claim 7 wherein said spade defines an angle within a range of about 25° to about 35° with respect to the handle.

13. The assembly of claim 7 wherein said bag comprises a biodegradable plastic material.

14. A method of affixing a disposable bag to a shovel for the purpose of shoveling and packaging animal refuse deposited by an animal on a surface, the shovel including a spaded loop that has a central opening and a spade with a leading edge, comprising:

inserting a central pocket of said bag into the central opening of said spaded loop;

inserting a forward pocket of said bag over the leading edge of the spade;

inserting a first section of a rear pocket of said bag over a first extended corner situated rearward of said leading edge;

tensioning said first section of said bag over said first extended corner, thereby tensioning said bag between said leading edge and said first extended corner;

affixing said first section to said first extended corner;

inserting a second section of the rear pocket of said bag over a second extended corner situated rearward of said leading edge and opposite from said first extended corner;

tensioning said second section of said bag over said second extended corner, thereby tensioning said bag between said leading edge, said first extended corner, and said second extended corner; and affixing said second section to said second extended corner.

15. The method of claim 14 wherein:

said step of tensioning said first section includes pulling said first section over a first shoulder provided on the first extended corner of said spaded loop; and said step of tensioning said second section includes pulling said second section over a second shoulder provided on a second extended corner of said spaded loop.

16. The method of claim 14 further comprising:

inserting said forward pocket over curved sections on first and second support arms proximate to the spade, said curved sections extending outwardly in an approximately horizontal direction from the spaded loop; and tensioning said bag against said curved sections to tighten the forward pocket along the underside of the spade.

17. The method of claim 14 further comprising:

shoveling animal refuse into the central pocket;

detaching said bag from said first and second extended corners;

inverting the rear pocket over the forward pocket thereby covering the forward pocket and sealing the bag;

removing the forward pocket from the spade; and disposing of the bag.

18. A shovel for receiving a disposable bag that has a central pocket, a forward pocket, and a rear pocket, said shovel comprising:

a handle;

a spaded loop connected to the handle, said spaded loop comprising a spade having a protruding leading edge for receiving said forward pocket so that said leading edge is substantially covered by said bag, a central opening for receiving said central pocket of said bag, and means for affixing said rear pocket of said bag to said spaded loop under tension, including a first extended corner and a second extended corner over which said rear pocket is tensioned, so that said bag is tensioned between said spade, said first extended corner, and said second extended corner, said second extended corner situated opposite said first extended corner.

19. The shovel of claim 18 wherein:

said first extended corner comprises a first shoulder extending away from said handle and said spade;

said affixing means further comprises a first lower edge situated below said first extended corner; and said second extended corner comprises a second shoulder extending away from said handle and said spade; and said affixing means further comprises a second lower edge situated below said second extended corner.

20. The shovel of claim 18 wherein said first and second extended corners are rounded.

21. The shovel of claim 18 wherein:

said spaded loop further comprises a first support arm situated between said spade and said first extended corner, said first support arm comprising a curved section proximate to the spade, said curved section extending outwardly in an approximately horizontal direction from the spaded loop; and said spaded loop further comprises a second support arm situated between said spade and said second extended corner, said second support arm comprising a curved section proximate to the spade, said curved section extending outwardly in an approximately horizontal direction from the spaded loop.

22. The shovel of claim 18 wherein said spade defines an angle within a range of about 25° to about 35° with respect to the handle.

23. The shovel of claim 18 wherein said handle is adjustable and extendible, and wherein said spade is tapered.

* * * * *